US009759124B2

(12) United States Patent
Jerch et al.

(10) Patent No.: US 9,759,124 B2
(45) Date of Patent: Sep. 12, 2017

(54) PILE HAMMER

(71) Applicant: DELMAG GmbH & Co. KG, Niedernberg (DE)

(72) Inventors: Leopold Jerch, Babenhausen (DE); Matthias Heichel, Aschaffenburg (DE)

(73) Assignee: DELMAG GmbH & Co. KG, Niedernberg (DE)

( * ) Notice: Subject to any disclaimer, the term of this patent is extended or adjusted under 35 U.S.C. 154(b) by 507 days.

(21) Appl. No.: 14/533,168

(22) Filed: Nov. 5, 2014

(65) Prior Publication Data

US 2015/0128900 A1 May 14, 2015

(30) Foreign Application Priority Data

Nov. 12, 2013 (EP) ..... 13192594

(51) Int. Cl.

| | |
|---|---|
| ***E02D 7/12*** | (2006.01) |
| ***F02B 11/02*** | (2006.01) |
| ***F02B 3/06*** | (2006.01) |
| *B25D 9/10* | (2006.01) |

(52) U.S. Cl.

CPC ..... *F02B 11/02* (2013.01); *E02D 7/12* (2013.01); *E02D 7/125* (2013.01); *F02B 3/06* (2013.01); *B25D 9/10* (2013.01)

(58) Field of Classification Search

CPC .. F02B 3/06; F02B 11/02; F02B 71/04; E02D 7/12; E02D 7/125; B25D 9/00; B25D 9/10; F01B 11/008; F01B 11/04

USPC ..... 173/1, 90, 128, 127, 133, 135, 137, 138, 173/206, 207, 209, 200, 210, 89; 123/46 SC, 46 H, 46 R

See application file for complete search history.

(56) References Cited

U.S. PATENT DOCUMENTS

| | | | | | |
|---|---|---|---|---|---|
| 1,082,162 | A | | 12/1913 | Leyner | |
| 2,633,832 | A | | 4/1953 | Spurlin | |
| 2,755,783 | A | | 7/1956 | Kupka | |
| 2,857,888 | A | * | 10/1958 | Guthrie | B25D 9/10 123/46 R |
| 3,161,184 | A | | 12/1964 | Koftan | |
| 3,651,873 | A | | 3/1972 | Uebel et al. | |
| 3,679,005 | A | | 7/1972 | Inaba et al. | |
| 3,721,095 | A | * | 3/1973 | Chelminski | E02D 7/00 173/1 |
| 3,788,402 | A | | 1/1974 | Chelminski | |
| 3,789,930 | A | | 2/1974 | Nishimura et al. | |
| 3,802,405 | A | | 4/1974 | Haussmann | |
| 3,822,969 | A | * | 7/1974 | Kummel | E02D 7/125 417/437 |
| 3,845,557 | A | | 11/1974 | Bailey | |
| 3,849,883 | A | | 11/1974 | Kolorz | |
| 3,897,851 | A | | 8/1975 | Heacox | |
| 3,923,017 | A | * | 12/1975 | Hennecke | E02D 7/125 123/298 |
| 3,945,119 | A | | 3/1976 | Nagashima et al. | |
| 3,967,688 | A | * | 7/1976 | Inenaga | E02D 7/125 123/46 H |
| 3,981,378 | A | | 9/1976 | Potter | |
| 4,020,804 | A | | 5/1977 | Bailey | |
| 4,067,402 | A | | 1/1978 | Schnell | |
| 4,076,081 | A | | 2/1978 | Schnell | |
| 4,079,794 | A | | 3/1978 | Schnell | |
| 4,096,916 | A | * | 6/1978 | Hennecke | E02D 7/125 123/46 H |
| 4,109,475 | A | * | 8/1978 | Schnell | E02D 7/125 123/46 H |
| 4,473,123 | A | * | 9/1984 | Ranft | E02D 7/125 173/1 |
| 4,497,376 | A | | 2/1985 | Kurylko | |
| 4,523,647 | A | | 6/1985 | Last | |
| 4,580,641 | A | | 4/1986 | Holland et al. | |
| 4,860,835 | A | | 8/1989 | Mauch | |
| 5,727,639 | A | | 3/1998 | Jeter | |
| 6,102,133 | A | * | 8/2000 | Scheid | E02D 7/26 173/1 |
| 6,112,831 | A | | 9/2000 | Gustafsson | |
| 6,634,324 | B1 | * | 10/2003 | Mewes | E02D 7/125 123/46 R |
| 6,736,218 | B1 | * | 5/2004 | White | E02D 7/125 173/135 |
| 6,988,564 | B2 | * | 1/2006 | White | E02D 7/125 173/135 |
| 7,926,690 | B1 | | 4/2011 | Tippmann, Sr. | |
| 8,763,719 | B2 | * | 7/2014 | White | E02D 7/125 173/1 |
| 9,255,375 | B2 | | 2/2016 | Yingling et al. | |
| 2001/0002230 | A1 | | 5/2001 | White | |
| 2009/0071672 | A1 | | 3/2009 | Heichel et al. | |
| 2010/0303552 | A1 | | 12/2010 | Yingling et al. | |

FOREIGN PATENT DOCUMENTS

| | | |
|---|---|---|
| EP | 1 828 488 B1 | 7/2008 |
| WO | 2006/072297 A1 | 7/2006 |

* cited by examiner

*Primary Examiner* — Scott A. Smith
(74) *Attorney, Agent, or Firm* — Collard & Roe, P.C.

(57) ABSTRACT

A pile hammer includes a cylinder, a piston displaceably guided in the cylinder, and a striker displaceably guided in the cylinder. The striker is disposed underneath the piston in the operating position of the pile hammer. A combustion chamber is delimited axially by a face surface of the striker that lies in the interior of the cylinder and by a face surface of the piston. Using at least one fuel feed device a predetermined amount of fuel can be introduced into the combustion chamber during each working cycle. A primary fuel feed device is provided, which includes a primary fuel nozzle connected with a primary fuel tank having a fuel with great anti-knock properties. The primary fuel nozzle is structured as a high-pressure injection nozzle. An ignition oil feed device is also provided, which includes an ignition oil nozzle connected with an ignition oil tank having an ignition oil. The ignition oil nozzle is structured as a low-pressure injection nozzle. A method operates such a pile hammer.

11 Claims, 1 Drawing Sheet

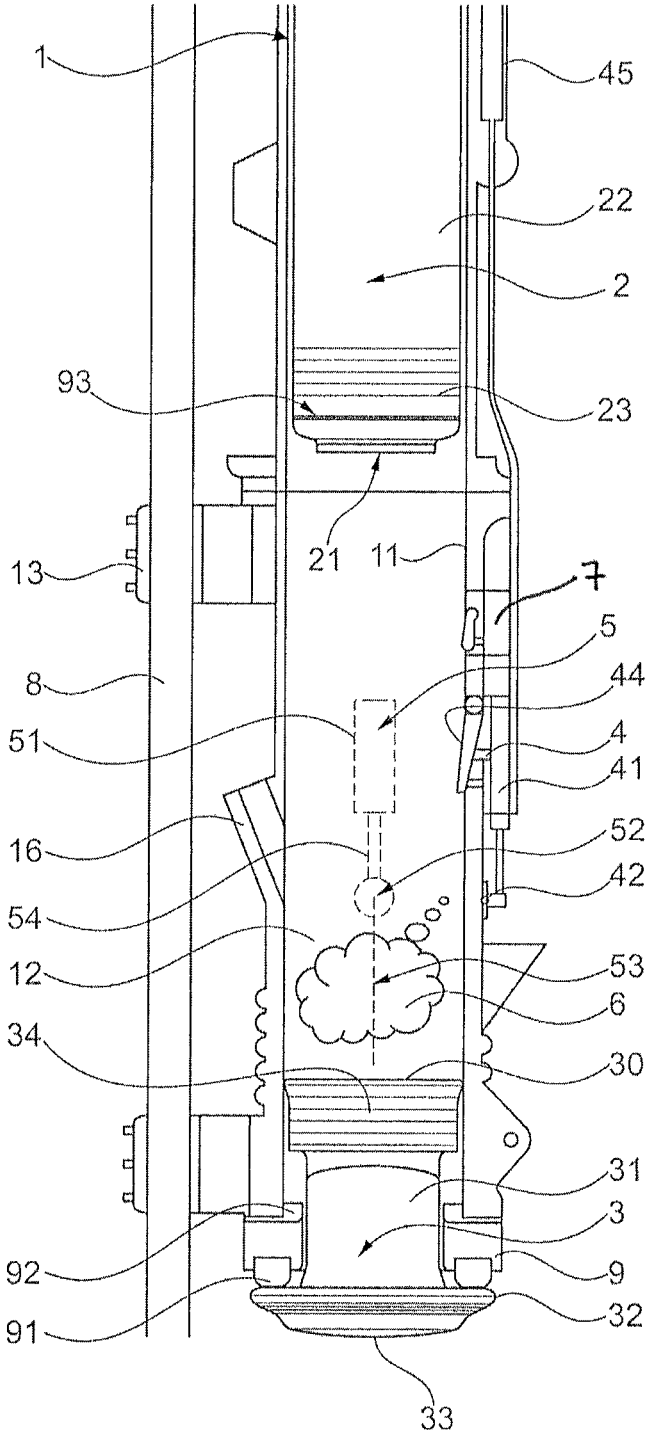
1
45
22
2
93
23
21
11
13
7
5
8
44
51
4
41
16
52
42
54
12
53
6
34
30
31
3
92
9
91
32
33

PILE HAMMER

CROSS REFERENCE TO RELATED APPLICATIONS

Applicant claims priority under 35 U.S.C. §119 of European Application No. 13 192 594.3 filed Nov. 12, 2013, the disclosure of which is incorporated by reference.

BACKGROUND OF THE INVENTION

1. Field of the Invention

The invention relates to a pile hammer comprising a cylinder, a piston displaceably guided in the cylinder and a striker displaceably guided in the cylinder. The invention furthermore relates to a method for operation of a pile hammer.

2. Description of the Related Art

Pile hammers, which are regularly operated with diesel oil in the state of the art, for which reason they are also called diesel hammer pile drivers, diesel hammers or diesel pile drivers, are particularly used in foundation work in the construction industry. The pile hammers are used for driving posts of all kinds, such as concrete pillars, iron beams, sheet pile wall elements or the like into a construction ground.

To start such a diesel hammer pile driver, the piston is pulled upward within the cylinder, using a disengagement apparatus, and disengaged at a specific height, thereby dropping downward onto the striker, under the effect of gravity. As it drops, the piston activates a fuel pump, by way of which feed of fuel, particularly diesel oil, takes place by way of one or more injection nozzles. The air situated in the combustion chamber of the cylinder is compressed by the dropping piston, and thereby heated so that the fuel/air mixture present in the combustion chamber is ignited, whereupon it combusts in the manner of an explosion. As a result of the explosion energy released during this process, for one thing the piston is accelerated back upward for a new work cycle; at the same time, the material being pile-driven is driven into the ground by way of the striker.

In the case of such diesel hammers, two types are known, with different methods for injecting diesel oil into the combustion chamber. In the case of what is called high-pressure injection, the fuel is injected into the combustion chamber of the cylinder, at high pressure, in the form of a finely atomized fuel mist, during compression of the air by the dropping piston. This mist, together with the air, forms an ignitable mixture. In the case of high-pressure injection, the fuel already ignites during the compression process, as soon as the compressed air reaches a temperature that suffices to ignite the fuel mixture. As the result of the explosion-like combustion, a high pressure is built up in the combustion chamber, by means of which the piston is braked, on the one hand. On the other hand, this combustion pressure acts on the striker, which exerts a force on the material to be pile-driven, thereby driving material this into the ground.

The compression process ends, at the latest, with the impact of the piston on the striker, whereby the piston, which after all was already braked before impact on the striker, by the expanding combustion products, does not impact the striker with full kinetic energy. At times, particularly in the case of a hard construction soil, the case can actually occur that the piston does not touch the striker at all and is accelerated upward again by the combustion gases, without any prior contact with the striker. Under such conditions, the striker acts on the material to be pile-driven only by way of the combustion gas cushion. For this reason, diesel hammers in which high-pressure injection is used are less suitable for driving heavy material to be pile-driven or in the case of difficult soil conditions with hard layers.

Furthermore, such a diesel hammer becomes very hot during operation, and the system of high-pressure injection tends to misfire when overheated. Such a system is furthermore susceptible to failure and has a relatively complicated structure. As a result, a diesel hammer with high-pressure injection has the disadvantage that it cannot be easily repaired or cannot be repaired at all on site, at construction sites.

Advantages of high-pressure injection can be seen as its good, relatively residue-free combustion, good starting behavior of the diesel hammer, as well as a good pile-driving effect in the case of soft soil layers.

In the case of what is called impact atomization, which is also called low-pressure injection, in contrast to high-pressure injection, the fuel is introduced into the combustion chamber at the beginning of the compression process, at a lower pressure, in the form of a fuel jet, and afterwards lies on the upper face side of the striker as a fuel puddle at first. The air in the combustion chamber is compressed by the dropping piston until the piston impacts the striker. At this moment, the liquid fuel is atomized by the impacting piston surface and ignites in this state, in the hot, compressed air. The piston is then accelerated upward by the explosion, whereupon a new work cycle can begin.

Until the impact onto the striker occurs, the piston is braked in its drop merely by the air situated in the combustion chamber and compressed by the piston. As a result, the movement energy of the piston is transferred to the striker, for the most part, thereby making it possible to exert clearly greater impact forces to the material to be pile-driven, at the same weight of the piston, than is the case for high-pressure injection. The impact of the piston on the striker takes place before the combustion of the fuel, in terms of time.

Diesel hammers that use low-pressure injection are less well suited for being used at low soil resistance values. In this case, the compression based on the low resistance of the soil is reduced, because the compression pressure that builds up is already transferred to the material to be pile-driven by way of the striker moving downward. The combustion chamber is thereby actually enlarged, and this enlargement in turn is at the expense of the compression pressure. In the case of soft soil, combustion takes place only at reduced quality, which can lead to undesirable residues (soot, non-combusted fuel in the combustion gases), which are a burden on the environment.

An advantage of impact atomization is that the movement energy of the piston is effectively utilized, because the piston has a hard impact on the striker. Furthermore, a diesel hammer using impact atomization has a lesser tendency to overheat, is less susceptible to failure, and is easier to operate than a diesel hammer using high-pressure injection.

The disadvantage of diesel hammers was that a diesel hammer operating according to one of the two working principles could only take specific local conditions into account. Up to the present, this disadvantage had to be accepted. If it turned out, on site, that the soil composition was or became different from what was planned in advance, either the work had to be continued with the non-optimal device or a different diesel hammer had to be procured, leading to loss of time and higher costs.

In WO 2006/072297 A1, a diesel hammer is described, in which the diesel oil can be injected into the combustion chamber optionally as an atomized fuel mist (high-pressure injection) and/or as a fuel jet (low-pressure injection). This diesel hammer has proven itself in practice. In the case of this diesel hammer, it is possible to operate it with high-pressure injection in the case of soft soil conditions, but with low-pressure injection or impact atomization in the case of hard soil layers. Thus adaptation of the effectiveness of the diesel hammer, with simultaneous optimization of combustion, to soft or hard layers of the soil is guaranteed.

In practice, however, it has been shown that incomplete fuel combustion can occur in the different operating modes, thereby causing combustion residues to remain in the combustion chamber.

SUMMARY OF THE INVENTION

The invention wishes to provide a remedy for this situation. The invention is based on the task of improving a pile hammer of the aforementioned type, with the function and reliability remaining the same, with the fuel combustion process improved, and with the formation of combustion residues prevented. According to the invention, this task is accomplished by means of a pile hammer including a cylinder, a piston displaceably guided in the cylinder, and a striker displaceably guided in the cylinder. The striker is disposed underneath the piston in the operating position of the pile hammer. A combustion chamber is delimited axially by a face surface of the striker that lies in the interior of the cylinder and by a face surface of the piston. Using at least one fuel feed device, a predetermined amount of fuel can be introduced into the combustion chamber during each working cycle. A primary fuel feed device is provided, which includes a primary fuel nozzle connected with a primary fuel tank having a fuel with great anti-knock properties. The primary fuel nozzle is structured as a high-pressure injection nozzle. An ignition oil feed device is also provided, which includes an ignition oil nozzle connected with an ignition oil tank having an ignition oil. The ignition oil nozzle is structured as a low-pressure injection nozzle.

With the invention, a pile hammer of the aforementioned type is created, in which the fuel combustion process is improved, with the function and reliability remaining the same, and the formation of combustion residues is prevented. Because a primary fuel feed device is provided, which comprises a primary fuel nozzle connected with a primary fuel tank having a fuel with great anti-knock properties, which nozzle is structured as a high-pressure injection nozzle, and that an ignition oil feed device is provided, which comprises an ignition oil nozzle connected with an ignition oil tank having an ignition oil, which nozzle is structured as a low-pressure injection nozzle, a precisely defined combustion process can be achieved. Homogeneous distribution of the fuel/air mixture is achieved by means of the use of a primary fuel having great anti-knock properties, thereby achieving an improvement in combustion. In this connection, the primary fuel can be introduced at the beginning of the compression cycle, thereby making more time available for formation of the mixture and evaporation of the primary fuel. The ignition of the primary fuel takes place by means of auto-ignition of the ignition oil, the ignition of which takes place precisely at the time of impact of the piston on the striker, in other words always at the optimal time.

Because only a minimal amount of ignition oil is required, in each instance, for spark ignition of the primary fuel/air mixture during each working cycle, a very clean and, in particular, low-particle combustion process is brought about. Any suitable fuel having great anti-knock properties, particularly ethanol, natural gas, liquid petroleum gas (LPG), biogas, super-gasoline or E85 fuel can be used as the primary fuel. Any suitable fuel that is auto-igniting by means of compression of heated combustion air, such as diesel oil, heating oil, biodiesel or kerosene can be used as the ignition oil.

In a further development of the invention, the ignition oil nozzle is configured so that the ignition oil can be applied to the striker in the form of a jet. In this way, puddle formation on the striker is achieved, thereby counteracting premature auto-ignition. In this connection, the primary fuel nozzle is preferably configured so that the primary fuel can be introduced into the combustion chamber in the form of an atomized fuel mist. The configuration of the primary fuel nozzle and the ignition oil nozzle must be coordinated with the primary fuel used.

In an embodiment of the invention, the primary fuel nozzle is disposed in such a manner that the fuel mist can be introduced into the combustion chamber in the vicinity of the face surface, orthogonal to the movement direction of the piston. In this way, homogeneous distribution of the primary fuel/air mixture is achieved.

In a further embodiment of the invention, the primary fuel nozzle and the ignition oil nozzle are disposed at different vertical distances from the striker. In this connection, the ignition oil nozzle is preferably disposed above the primary fuel nozzle, viewed from the striker. In this way, the jet-shaped introduction of an ignition oil puddle onto the striker can take place first, whereupon injection of the primary fuel takes place after increasing compression of the air. In this way, premature auto-ignition of the ignition oil is further counteracted.

In a further development of the invention, the primary fuel nozzle and the ignition oil nozzle are connected with a pump device, in each instance, which devices can be controlled by the dropping piston. Preferably, at least one of the pump devices has a plunger that projects into the cylinder and is configured in such a manner that it activates a pump device as the result of passing the piston as it drops, by which device an injection process is initiated. In this way, mechanical, very robust control of the fuel injection process, not susceptible to failure, is achieved.

The invention is furthermore based on the task of making available a method for operation of a pile hammer of the aforementioned type, which method allows an improvement in the fuel combustion process, with the function and reliability of the pile hammer remaining the same, with simultaneous avoidance of the formation of combustion residues. According to the invention, this task is accomplished by means of a method wherein during each cycle, a fuel pump is activated by the dropping of the piston. By means of this fuel pump anti-knock primary fuel is introduced into the combustion chamber by way of a primary fuel nozzle structured as a high-pressure injection nozzle, thereby forming a primary fuel/air mixture in the combustion chamber, and an ignition oil pump is activated. By means of this ignition oil pump a small amount of ignition oil is sprayed onto the striker by way of an ignition oil nozzle structured as a low-pressure injection nozzle, whereupon the ignition oil is atomized and ignited when the piston impacts the striker, thereby causing ignition of the primary fuel/air mixture to take place.

With the invention, a method for operation of a pile hammer of the aforementioned type is made available, which method allows an improvement in the fuel combustion process, with the function and reliability of the pile hammer remaining the same, with simultaneous avoidance of the formation of combustion residues. Because the ignition of the primary fuel/air mixture takes place only upon impact of the piston, by the auto-ignition of the ignition oil, good homogenization of the primary fuel/air mixture is brought about, thereby promoting optimal combustion. In this connection, primary fuel and ignition oil are preferably introduced into the combustion chamber at different times.

Particularly preferably, first a small amount of ignition oil is sprayed onto the striker, thereby forming an ignition oil puddle, and afterward, the primary fuel is introduced into the combustion chamber in the form of an atomized fuel mist, before the ignition oil situated on the striker is atomized and ignited as the result of the impact of the piston on the striker.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings:

The single FIGURE shows a schematic representation of a pile hammer.

DETAILED DESCRIPTION OF PREFERRED EMBODIMENTS

Referring now in detail to the drawings, the pile hammer shown in the sole FIGURE selected as an exemplary embodiment comprises a cylinder 1 that is open on both sides, and regularly can have a length of 3 to 8 meters and a diameter of 0.2 to 1.5 meters. A piston 2 is displaceably disposed in the cylinder 1. A striker 3 coaxial to the piston 2 engages into the open lower end of the cylinder 1, in displaceable manner. A ring-shaped bearing unit 9 is attached at the lower end of the cylinder 1, in which unit a central shaft section 31 of the striker 3 is guided in tight and displaceable manner. Central shaft section 31 has an outside diameter that is reduced as compared with the inside diameter of the cylinder 1. The pile hammer is mounted so as to be vertically displaceable along a leader 8, by way of guide jaws 13 disposed on the cylinder 1.

A strike plate 32 is formed onto the lower end of the shaft section 31, lying underneath the cylinder 1, the lower convex delimitation surface 33 of which plate, directed outward, interacts with the upper end of a material to be pile-driven, during operation.

A piston section 34 having multiple circumferential sealing rings, axially at a distance from one another, which run on the inner mantle surface 11 of the cylinder 1, is formed on at the upper end of the shaft section 31 of the striker 3. A combustion chamber 12 is delimited by the top of the piston section 34 of the striker 3, together with the underside of the piston 2, as well as the inner mantle surface 11 of the cylinder 1. The face surface of the striker 3 that faces the combustion chamber 12 of the cylinder 1 is ground to be level with a flat fuel bowl.

A damping ring 91 is disposed between the strike plate 32 of the striker 3 and the bearing unit 9 of the cylinder 1. A further damping ring 92 is disposed adjacent to the bearing unit 9, between the top of the bearing unit 9 and the underside of the piston section 34 of the striker 3.

A lower working end 23 of the piston 2, provided with circumferential sealing rings 93 that are axially spaced apart from one another, runs in the interior of the cylinder 1, above the striker 3. The lower, free face surface 21 of the piston 2, ground to be planar, is set off by a circumferential step that lies radially on the outside.

A mass section 22 that extends into the upper section of the cylinder 1 is formed onto the lower working end 23 of the piston 2. A primary fuel feed device 4 is disposed on the circumference wall of the cylinder 1. This primary fuel feed device 4 comprises a primary fuel pump 41 that is connected with the primary fuel nozzle 42, configured in the form of a high-pressure injection nozzle, by way of a line. The primary fuel pump 41 is supplied with a fuel having great anti-knock properties, ethanol in the present case, by way of a primary fuel tank 45. In place of ethanol, natural gas, LPG, biogas, super-gasoline or E85 fuel (gasoline-ethanol mixture with 85 percent ethanol proportion), for example, can also be used.

The primary fuel pump 41 connected with the primary fuel tank 45 by way of a line has a biased pump lever 44 that projects into the interior of the cylinder 1, by way of which the pump is driven when the dropping piston 2 goes past. The primary fuel feed device 4, particularly its primary fuel nozzle 42, is configured and oriented in such a manner that the primary fuel emitted is sprayed into the combustion chamber 12 essentially as a finely atomized mist.

Furthermore, an ignition oil pump 51 that is driven by means of a pump lever 54 biased into the interior of the cylinder 1 when the piston 2 drops is connected with an ignition oil nozzle 52 configured as a low-pressure injection nozzle, by way of a line, on the conveying side, and forms an ignition oil feed device 5 together with this nozzle. The ignition oil pump 51 communicates with an ignition oil tank filled with diesel oil used as the ignition oil. The ignition oil feed device 5 is disposed on and in the circumference wall of the cylinder 1, axially at a distance from the primary fuel feed device 4 in the direction toward the upper end of the cylinder 1. Its ignition oil nozzle 52 is configured and oriented in such a manner that the ignition oil emitted is sprayed approximately centrally along line 53 onto the face surface of the striker 3, in the form of an essentially cohesive jet.

The configuration of the primary fuel pump 41 and the ignition oil pump 51, with a respective pump lever 44, 54 provided, projecting into the cylinder 1, essentially corresponds, in the exemplary embodiment, to the embodiment of the fuel pumps of the low-pressure injection apparatus described in WO 2006/072297 known from the prior art. For this reason, reference is made to the explanations contained in this document, at this point, with regard to these pumps.

Furthermore, a lubricant pump 7 is provided on the cylinder 1, which is connected with lubricant nozzles distributed in the circumference direction of the cylinder 1. Lubricant is applied between the piston 2 and the inner mantle surface 11 of the cylinder 1 by the lubricant nozzles.

The pile hammer described above works as follows: In the starting state, the piston 2 is raised into an upper position by way of the disengagement apparatus—not shown. After disengagement, it falls downward from there, under the effect of gravity, closes the working connectors 16, and, one after the other, activates the pump levers 54, 44 of the ignition oil feed device 5 and the primary fuel feed device 4 with its face surface 21. As a result, first jet-like application of a small amount of ignition oil onto the striker 3, forming a puddle there, takes place. Subsequently, the primary fuel, ethanol in the present case, is injected into the combustion chamber 12 in atomized form, by way of the primary fuel nozzle 42, which fuel is thereby mixed with air and compressed by way of the dropping piston 2. When the piston 2 impacts the striker 3, the ignition oil puddle is atomized and auto-ignited, thereby causing ignition of the compressed primary fuel/air mixture 6 to take place.

When the piston 2 impacts the striker 3, a force directed downward is more or less exerted on the striker 3 and, by way of the striker 3, on the material to be pile-driven, which force drives the material to be pile-driven further into the ground. During the subsequent upward movement of the piston 2, triggered by the explosion-like combustion of the primary fuel, the piston releases the working connectors 16 again, thereby causing the combustion gases to relax and to flow away by way of the working connectors 16. The piston 2 is now accelerated further upward, drawing fresh air in through the working connectors 16, until it has reached its upper end position and the work cycle, as described, is repeated.

Although only a few embodiments of the present invention have been shown and described, it is to be understood that many changes and modifications may be made thereunto without departing from the spirit and scope of the invention.

What is claimed is:

1. A pile hammer comprising:

(a) a cylinder having an interior;

(b) a primary fuel tank having a fuel with anti-knock properties;

(c) an ignition oil tank having an ignition oil;

(d) a piston displaceably guided in the cylinder and having a piston face surface;

(e) a striker displaceably guided in the cylinder and disposed underneath the piston in an operating position, said striker having a striker face surface lying in the interior of the cylinder;

(f) a combustion chamber delimited axially by the striker face surface and by the piston face surface;

(g) a primary fuel feed device comprising a primary fuel nozzle structured as a high-pressure injection nozzle connected with the primary fuel tank for introduction of a predetermined amount of the fuel into the combustion chamber during each working cycle; and (h) an ignition oil feed device comprising an ignition oil nozzle structured as a low-pressure injection nozzle connected with the ignition oil tank.

2. The pile hammer according to claim 1, wherein the ignition oil nozzle is configured so that the ignition oil is applied to the striker as a jet.

3. The pile hammer according to claim 1, wherein the primary fuel nozzle is configured so that the fuel from the primary fuel tank is introduced into the combustion chamber as an atomized fuel mist.

4. The pile hammer according to claim 3, wherein the primary fuel nozzle is disposed so that the fuel mist is introduced into the combustion chamber near the striker face surface, orthogonally to a movement direction of the piston.

5. The pile hammer according to claim 1, wherein the primary fuel nozzle and the ignition oil nozzle are disposed at different vertical distances from the striker.

6. The pile hammer according to claim 5, wherein the ignition oil nozzle is disposed above the primary fuel nozzle, viewed from the striker.

7. The pile hammer according to claim 1, wherein the primary fuel nozzle and the ignition oil nozzle are connected with first and second pump devices, respectively, wherein the first and second pump devices are controllable by dropping the piston.

8. The pile hammer according to claim 7, wherein at least one of the first and second pump devices has a pump lever that projects into the interior of the cylinder 1 and is configured and oriented so that the pump device is activated when the piston drops past the pump lever, thereby initiating an injection process.

9. A method for operating a pile hammer comprising a cylinder having an interior, a primary fuel tank having a fuel with anti-knock properties, an ignition oil tank having an ignition oil, a piston displaceably guided in the cylinder and having a piston face surface, a striker displaceably guided in the cylinder and disposed underneath the piston in an operating position, the striker having a striker face surface lying in the interior of the cylinder, a combustion chamber delimited axially by the striker face surface and by the piston face surface, a primary fuel feel device comprising a primary fuel nozzle structured as a high-pressure injection nozzle for introduction of a predetermined amount of fuel into the combustion chamber during each working cycle, and an ignition oil feed device comprising an ignition oil nozzle structured as a low-pressure ignition nozzle connected with the ignition oil tank, said method comprising:

(a) during each work cycle, activating a fuel pump by dropping the piston to cause the fuel with anti-knock properties to be introduced into the combustion chamber and by way of the primary fuel nozzle, thereby forming a primary fuel/air mixture in the combustion chamber;

(b) activating the ignition oil pump to spray an amount of ignition oil onto the striker by way of the ignition oil nozzle; and (c) atomizing and igniting the ignition oil when the piston impacts the striker to cause ignition of the primary fuel/air mixture to take place.

10. The method according to claim 9, wherein the fuel with the anti-knock properties and the ignition oil are introduced into the combustion chamber at different times.

11. The method according to claim 10, wherein an ignition oil puddle forms from the amount of ignition oil sprayed onto the striker, and afterward, the fuel with anti-knock properties is introduced into the combustion chamber as an atomized fuel mist, before the ignition oil situated on the striker is atomized and ignited as a result of the piston impacting the striker.

* * * * *